US005690379A

United States Patent [19]

Cayssials

[11] Patent Number: 5,690,379

[45] Date of Patent: Nov. 25, 1997

[54] DECORATIVE FURNITURE ITEM USABLE AS CHAIR, STEP STOOL AND ROCKER

[76] Inventor: Theresa L. Cayssials, 181 Goodwin Dr., San Bruno, Calif. 94066

[21] Appl. No.: 743,167

[22] Filed: Nov. 4, 1996

[51] Int. Cl.[6] ..... A47C 13/00

[52] U.S. Cl. ..... 297/118; 297/1; 297/181; 297/271.6

[58] Field of Search ..... 297/181, 118, 297/1, 3, 258.1, 271.1, 271.5, 271.6; D6/351, 358, 359, 388

[56] References Cited

U.S. PATENT DOCUMENTS

| | | |
|---|---|---|
| D. 265,950 | 8/1982 | Martin . |
| D. 354,174 | 1/1995 | Collins et al. . |
| D. 355,773 | 2/1995 | MacOwan . |
| D. 357,128 | 4/1995 | Watson et al. . |
| D. 361,904 | 9/1995 | Reese . |
| 3,879,083 | 4/1975 | Olsson . |
| 3,964,790 | 6/1976 | Bergeron . |

FOREIGN PATENT DOCUMENTS

| | | |
|---|---|---|
| 1654298 | 2/1971 | Germany . |
| 2023412 | 1/1980 | United Kingdom . |

*Primary Examiner*—Milton Nelson, Jr.
*Attorney, Agent, or Firm*—Richard C. Litman

[57] ABSTRACT

A decorative furniture item which a user may selectively move into a first arrangement for use as a stationary chair/step stool or into a second arrangement as a rocking chair. The transformation from one use to the other use is easily accomplished by the user turning the furniture item to the desired position. The decorative furniture item symbolizes a particular theme, such as a sport, a bird, an animal and the like. In one sport theme, the furniture item resembles two footballs supporting a chair structural arrangement. In other embodiments, the arrangements relate to a sport theme for baseball, tennis or golf. In another embodiment, the arrangement has a duck appearance. Each of the various structural arrangements constitute a readily assembled kit.

6 Claims, 4 Drawing Sheets

FIG. 3
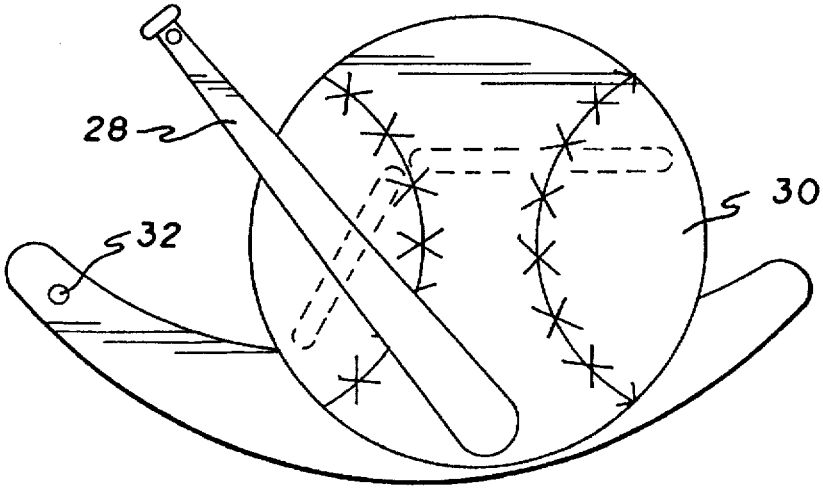
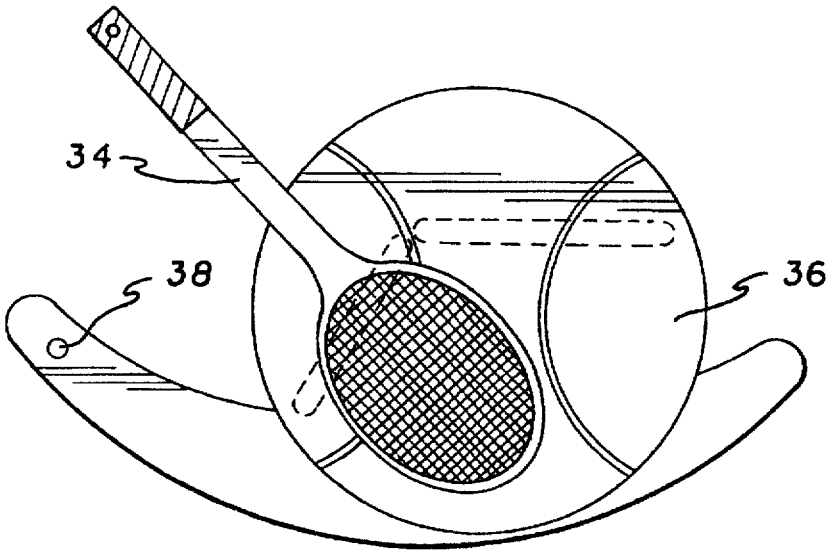
FIG. 4

FIG. 5
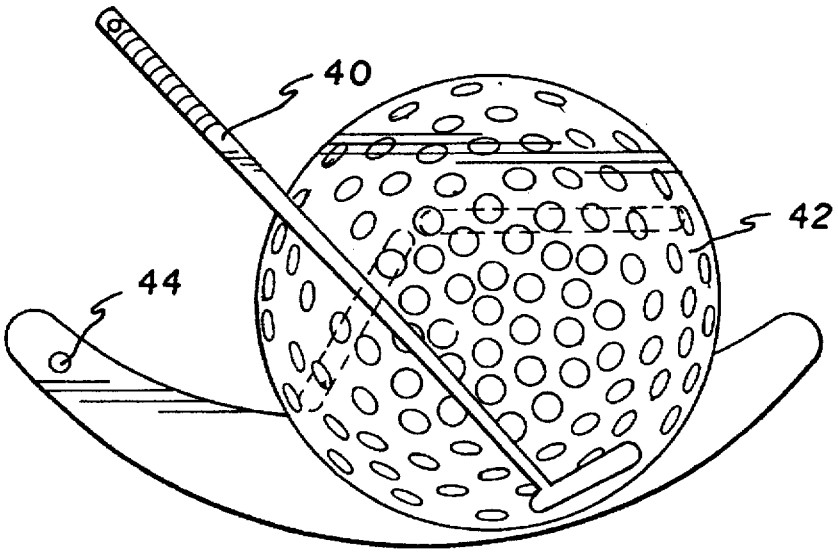
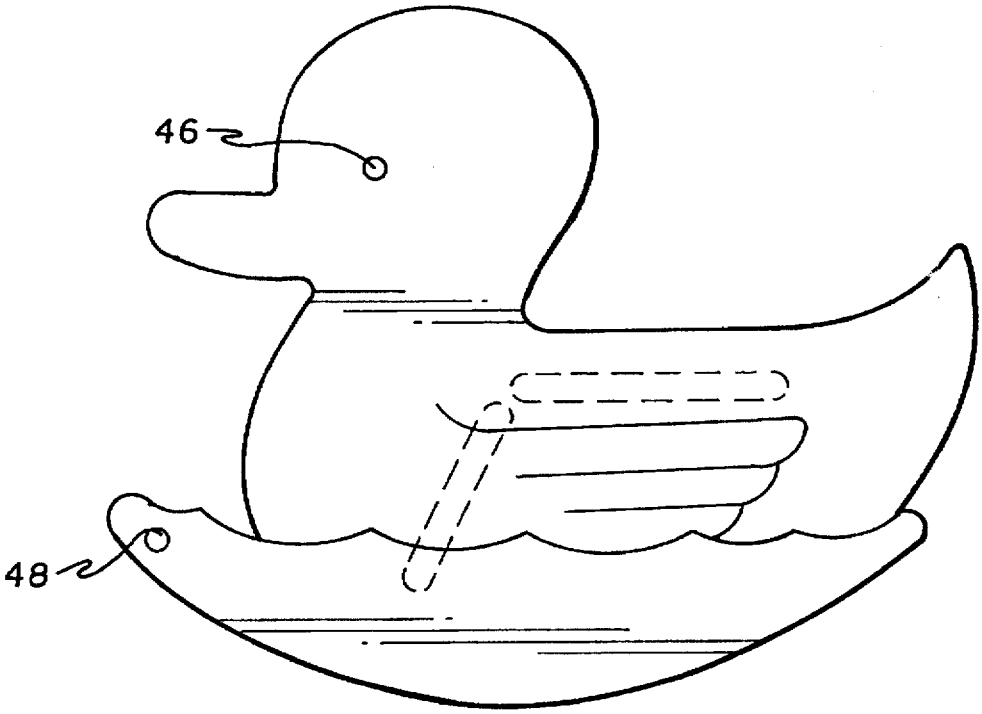
FIG. 6

DECORATIVE FURNITURE ITEM USABLE AS CHAIR, STEP STOOL AND ROCKER

BACKGROUND OF THE INVENTION

1. Field of the Invention

The present invention relates generally to a decorative furniture item selectively usable as a chair, step stool and rocker, which furniture item symbolizes a particular theme, such as a sport, a bird, an animal and the like. More specifically, the invention relates to a decorative item of furniture which a user may selectively move into a first position for use as a stationary chair/step stool or into a second position for use as a rocking chair.

2. Description of Prior Art

Combined furniture items are well known in the art, as exemplified by the following patents.

U.S. Pat. No. Design 265,950, issued on Aug. 31, 1982 to Rosemary E. A. Martin, shows a rocking seat with a half moon design for the bottom of the chair. U.S. Design Pat. No. 354,174, issued on Jan. 10, 1995 to Kyle R. Collins et al., shows a design for a shoe shaped seating device. U.S. Design Pat. No. 355,773, issued on Feb. 28, 1995 to Michael B. MacOwan, shows a design for a combined stool and stringed instrument support. U.S. Pat. Design No. 357,128, issued on Apr. 11, 1995 to Margaret Watson et al., shows a design for a combination high chair, rocking horse, and desk. U.S. Design Pat. No. 361,904, issued on Sep. 5, 1995 to Michael S. Reese, shows a design for a crescent chair. None of these design patents shows a decorative furniture item selectively usable as a chair, step stool and rocker, which furniture item symbolizes a particular theme, such as a sport, a bird, an animal and the like, as shown by the present invention.

U.S. Pat. No. 3,879,083, issued on Apr. 22, 1975 to Gote Olsson, discloses a combination furniture comprising a rocking-chair, a children's chair and a car for playing purposes. U.S. Pat. No. 3,964,790, issued on Jun. 22, 1976 to Gaetan G. Bergeron, describes pieces of furniture which are assembled from segments of a closed hollow shell formed by severing the hollow shell and providing segments of different sizes of ball furniture. German Patent Document No. 1,654,298, dated Feb. 18, 1971 to Johannes Larsen, shows various forms of foldable type furniture. United Kingdom Patent Document No. 2,023,412, dated Jan. 3, 1980 to Joseph W. Clive, shows a rucksack for use as a loading-carrying device and also can function as a portable seat. None of the above patents disclose a decorative piece of furniture assembly which a user may selectively move into a first position for use as a stationary chair/step stool or into a second position as a rocking chair. Nor do the patents disclose a decorative furniture item which symbolizes a particular theme, such as a sport, a bird, an animal and the like, as defined by the present invention.

None of the above inventions and patents, taken either singly or in combination, is seen to describe the instant invention as claimed.

SUMMARY OF THE INVENTION

The present invention relates to a decorative piece of furniture assembly which a user may selectively move into a first arrangement for use as a stationary chair/step stool unit or into a second arrangement as a rocking chair unit. The transformation from one arrangement to the other arrangement is easily accomplished by the user turning the furniture item to the desired position. The decorative furniture item symbolizes a particular theme, such as a sport, a bird, an animal and the like. In one sport theme, the furniture item resembles two footballs supporting a chair structural arrangement. In other embodiments, the arrangements relate to a sport theme for baseball, tennis or golf. In another embodiment, the arrangement has a duck appearance. Each of the various structural arrangements constitute a readily assembled kit.

Accordingly, it is a principal object of the invention to provide a decorative furniture item selectively usable as a chair, a step stool and a rocker.

It is another object of the invention to provide a furniture item which symbolizes a particular theme, such as a sport, a bird, an animal and the like.

It is a further object of the invention to provide a decorative furniture item which symbolizes a particular sport theme, such as football, baseball, tennis or golf.

Still another object of the invention is to provide various decorative furniture items, each of which constitutes a kit which is simple to construct and is readily assembled.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 3 is a left side elevational view of the furniture item, showing its use as a baseball structural arrangement.

FIG. 4 is a left side elevational view of the furniture item, showing its use as a tennis structural arrangement.

FIG. 5 is a left side elevational view of the furniture item, showing its use as a golf structural arrangement.

FIG. 6 is a left side elevational view of the furniture item, showing its use as a duck structural arrangement.

Similar reference characters denote corresponding features consistently throughout the attached drawings.

DETAILED DESCRIPTION OF THE PREFERRED EMBODIMENT

In its broadest aspects the present invention relates to a decorative furniture item which a user may selectively move into a first position for use as a stationary chair/step stool unit or into a second position for use as a rocking chair unit. The transformation from one use to the other use is easily accomplished by the user turning the furniture item to the desired position. The decorative furniture item symbolizes a particular theme, such as a sport, a bird, an animal and the like. In one sport theme, the furniture item resembles two footballs supporting a chair structural arrangement. In other embodiments, the arrangements relate to a sport theme for baseball, tennis or golf. In another embodiment, the arrangement has a duck appearance. Each of the various structural arrangements constitute a readily assembled kit.

Figure 1:
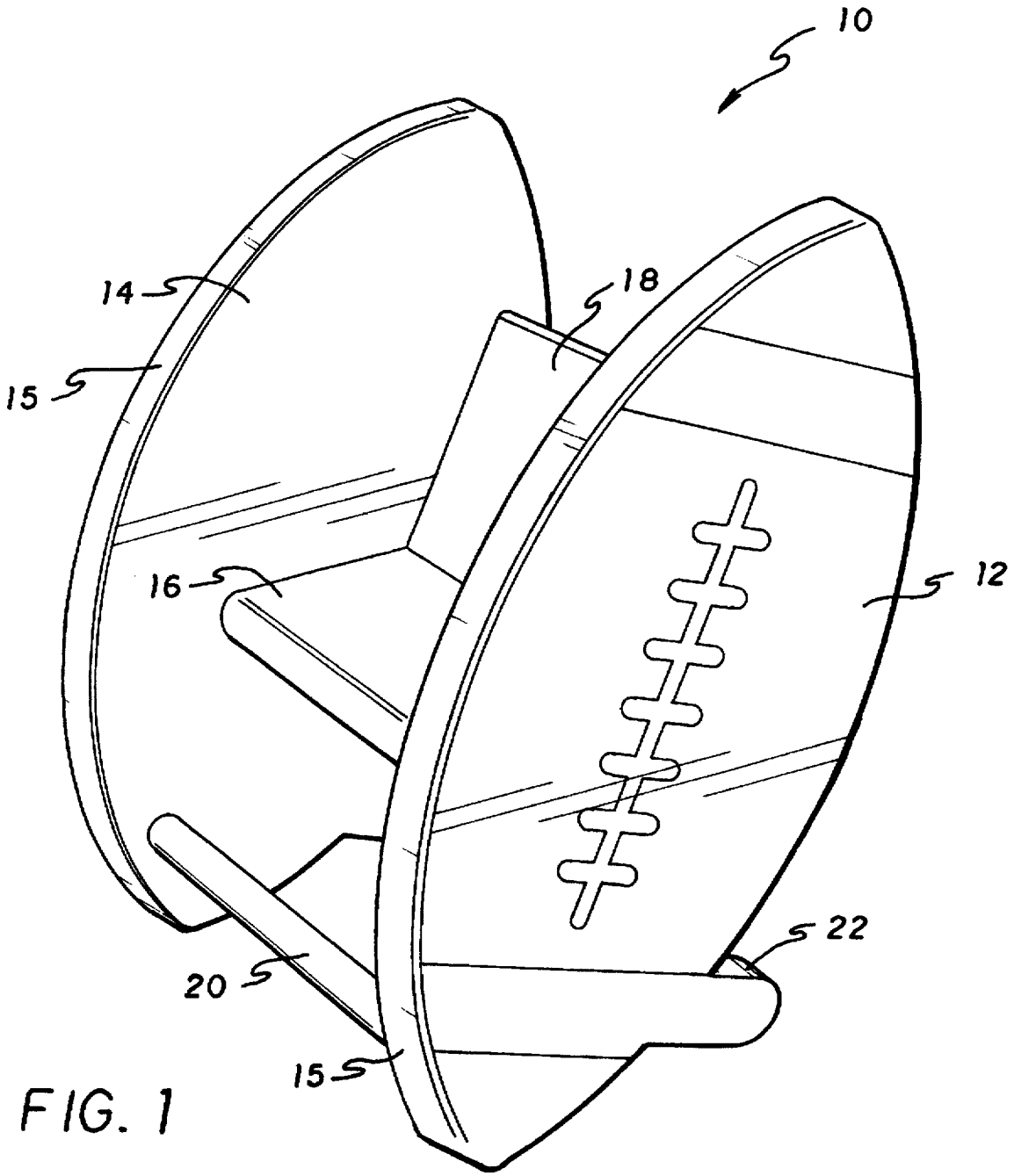
FIG. 1 is a left side perspective view of the football-designed furniture item, showing its use as a stationary chair/step stool, in accordance with the present invention.
Figure 2:
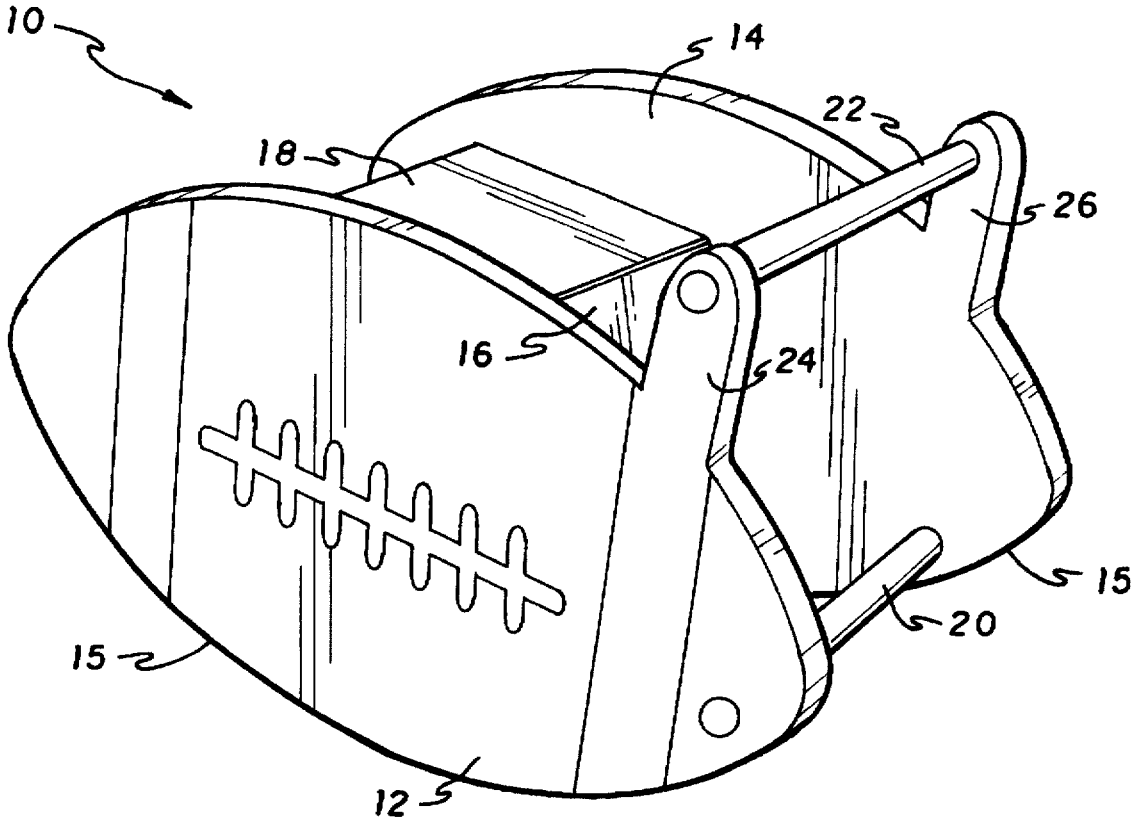
FIG. 2 is a left side perspective view of FIG. 1, showing its use as a rocking chair.

With reference to FIGS. 1–2, there is illustrated a first embodiment of a furniture item 10 identified with a particular theme. The furniture item 10 includes a first elongated body 12 and a second elongated body 14. Each of the first and second elongated bodies 12, 14 is identified with a particular theme, that is selected from a group consisting of a sport, an animal and a bird. Both the first and second elongated bodies 12, 14 have a particular configuration, representing the selected theme, which in this embodiment is the sport of football. Each of the first and second elongated bodies 12, 14 is the substantially mirror image of the other and resembles the implement used in identifying the selected theme of football. Each elongated body 12, 14 has curved edge 15 allowing furniture item 10 to be used as rocker as shown in FIG. 2. On the outer sidewall of each of the first and second football-shaped bodies, there is a configuration of the laces or strings of the football, which together with the oblong football shape of the sidewalls, support the football theme of the first embodiment. The furniture item 10 further includes a first rectangular-shaped plate 16 which is mounted in a perpendicular manner or orthgonally between the first and second elongated bodies 12, 14 at substantially the median point of each of the respective elongated body 12, 14 and is dimensioned and configured for supporting a seat or a foot of a user. FIG. 1 is a view of the football-designed furniture item 10, showing its use as a stationary chair/step stool unit.

Further, a second rectangular-shaped plate 18 is mounted in a perpendicular manner or orthgonally between the first and second elongated bodies 12, 14 and is contiguous to the first rectangular-shaped plate 16 at an obtuse angle such that first plate 16 extends from said second plate 18 generally toward curved edge 15 of each elongated body 12, 14. The first plate 16 dimensioned and configured for supporting a seat or a back of the user, depending on whether the furniture item 10 is being used as chair/step stool unit, as shown in FIG. 1 or as a rocking chair unit, as shown in FIG. 2.

Further, bar means are provided for the furniture item 10 for the purposes of reenforcing and also serve as handle structures. The bar means are mounted in a perpendicular manner or orthgonally between the first and second elongated bodies 12, 14. The bar means are respectively spaced from the first and second elongated bodies 12, 14 and provide a positioning means, as well as a handling means, which allows the user to selectively move the furniture item 10 into a position for use as a stationary chair/step stool unit or into another position for use as a rocking chair unit.

More specifically, the bar means are a first bar 20 and a second bar 22. The first bar 20 constitutes a foot rest when the furniture item 10 is being used as the stationary chair/step stool unit or the rocker unit. As shown in FIG. 2, the second bar 22 is mounted on a first and second stem members 24, 26, respectively, which are tabs that extend upwardly and serve as the supports for the chair/step stool position and second bar 22, which is spaced from the two bodies 12, 14 as shown in FIG. 2.

In the first embodiment discussed above with respect to FIGS. 1–2, the sport theme was football, shown by the structural arrangement which included the two elongated football-shaped bodies 12, 14. In the second embodiment in FIG. 3, the sport theme is baseball, showing a structural arrangement which includes a baseball bat 28, a baseball 30 and a foot rest 32 for the chair seat. In the third embodiment of FIG. 4, the sport theme is tennis, showing a structural arrangement which includes a tennis racket 34 , a tennis ball 36 and a foot rest 38. In the fourth embodiment in FIG. 5, the sport theme is golf, showing a structural arrangement which includes a golf club 40, a golf ball 42 and a foot rest 44. In the fourth embodiment shown in FIG. 6, the theme expressed is a duck-shaped structural arrangement which includes a handle section 46 and a foot rest 48.

Thus, in each of the embodiments of FIGS. 3–6, the respective structural arrangements are similar to the above detailed description of the football embodiment in FIG. 1. In each of the embodiments in FIGS. 3–6, there are included first and second rectangular-shaped plates as shown by the dotted lines in the respective drawing figures. The substantial horizontal dotted line section is the rocker seat or chair back rest/step stool toe kick. The dotted line section contiguous to the horizontal dotted line section constitutes the chair seat or the foot platform for the step stool.

Various modifications may be made to the present invention. The scope of the invention is not restricted to the disclosed themes of the sports of football, baseball, tennis and golf and the duck, but obviously may include many other types of themes.

It is to be understood that the present invention is not limited to the embodiments described above, but encompasses any and all embodiments within the scope of the following claims.

I claim:

1. A decorative furniture item usable as a chair, step stool and rocker comprising:

a first elongated body;

a second elongated body in a spaced apart parallel relationship with said first elongated body, each of said bodies having a curved edge for use as a rocker and an opposite edge having a stem protruding therefrom;

a first rectangular plate mounted orthogonally between said first and second elongated bodies;

a second rectangular plate mounted orthogonally between said first and second elongated bodies, said second plate oriented generally horizontally when said furniture item rests on the curved edge of each of said elonqated bodies, said second plate forming an obtuse angle with said first plate, said first plate extending from said second plate generally toward said curved edge of each of said elonqated bodies;

a first bar mounted orthogonally between said first and second elongated bodies; and a second bar mounted orthogonally between said stems; whereby upon resting said decorative furniture item on said stems with said first plate in a horizontal orientation, said decorative furniture item is usable as step stool and chair with said first plate serving as a step and chair seat, said second plate serving as a toe kick and chair back, and said first bar serving as a foot rest; and upon resting said decorative furniture item on said curved edge of each of said elongated bodies, said decorative furniture item is useable as a rocker with said second plate serving as a seat, said first bar serving as a foot rest and said second bar serving as a handle bar.

2. The decorative furniture item according to claim 1, wherein each of said first and second elongated bodies has a tennis ball configuration.

3. The decorative furniture item according to claim 1, wherein each of said first and second elongated bodies has a golf ball configuration.

4. The decorative furniture item according to claim 1, wherein each of said first and second elongated bodies has a duck configuration.

5. The decorative furniture item according to claim 1, wherein each of said first and second elongated bodies has a football configuration.

6. The decorative furniture item according to claim 1, wherein each of said first and second elongated bodies has a baseball configuration.

* * * * *